US010997812B2

(12) United States Patent
Razzaboni et al.

(10) Patent No.: US 10,997,812 B2
(45) Date of Patent: May 4, 2021

(54) MACHINE FOR FILLING CASH BOXES AND DEVICE FOR RECEIVING AND MOVING A CASH BOX FOR SUCH A MACHINE

(71) Applicant: CIMA S.P.A., Mirandola (IT)

(72) Inventors: Nicoletta Razzaboni, Mirandola (IT); Vittorio Razzaboni, Mirandola (IT)

(73) Assignee: CIMA S.P.A., Mirandola (IT)

( * ) Notice: Subject to any disclaimer, the term of this patent is extended or adjusted under 35 U.S.C. 154(b) by 0 days.

(21) Appl. No.: 16/321,956

(22) PCT Filed: Aug. 7, 2017

(86) PCT No.: PCT/IB2017/054816

§ 371 (c)(1),
(2) Date: Jan. 30, 2019

(87) PCT Pub. No.: WO2018/029592

PCT Pub. Date: May 15, 2018

(65) Prior Publication Data

US 2019/0180549 A1 Jun. 13, 2019

(30) Foreign Application Priority Data

Aug. 9, 2016 (IT) ..... 102016000083998

(51) Int. Cl.
*G07D 11/00* (2019.01)
*G07D 11/16* (2019.01)
(Continued)

(52) U.S. Cl.
CPC ..... *G07D 11/16* (2019.01); *G07D 1/00* (2013.01); *G07D 9/00* (2013.01); *G07D 11/10* (2019.01);
(Continued)

(58) Field of Classification Search
CPC ... G07F 1/00; G07D 1/00; G07D 9/00; G07D 9/002; G07D 9/04; G07D 9/06;
(Continued)

(56) References Cited

U.S. PATENT DOCUMENTS 4,756,449 A * 7/1988 Miura ..... G07D 11/10 221/129
4,988,849 A * 1/1991 Sasaki ..... G06Q 20/1085 235/379
(Continued)

FOREIGN PATENT DOCUMENTS

DE 202005020965 U1 11/2006
EP 2680213 A1 1/2014
WO 2008024043 A1 2/2008

OTHER PUBLICATIONS

International Search Report for corresponding application PCT/IB2017/054816 filed Aug. 7, 2017; dated Oct. 10, 2017.
(Continued)

*Primary Examiner* — Thien M Le
*Assistant Examiner* — April A Taylor
(74) *Attorney, Agent, or Firm* — Cantor Colburn LLP

(57) ABSTRACT

A machine for filling cash boxes insertable into and extractable from the machine, including internally a portion for housing storage containers containing a cash reserve intended to fill the cash boxes, laterally to said inner storage containers a device for receiving and moving a cash box is arranged, the device for receiving and moving the cash box being equipped with at least means for vertical movement of the cash box between a raised position, adapted for inserting and extracting it into and from the machine, and a lowered position, at a lower height with respect to that of the inner storage containers present in the machine, the device also being equipped with means for horizontal movement of the
(Continued)

cash box between the lowered position and a position distanced from it, arranged under the inner storage containers present in the machine.

18 Claims, 4 Drawing Sheets

(51) Int. Cl.

| | |
|---|---|
| ***G07G 1/00*** | (2006.01) |
| ***G07D 1/00*** | (2006.01) |
| ***G07F 1/00*** | (2006.01) |
| ***G07D 11/40*** | (2019.01) |
| ***G07D 9/00*** | (2006.01) |
| ***G07D 11/10*** | (2019.01) |
| *G07D 9/04* | (2006.01) |

(52) U.S. Cl.
CPC ..... *G07D 11/40* (2019.01); *G07F 1/00* (2013.01); *G07G 1/0018* (2013.01); *G07G 1/0027* (2013.01); *G07D 9/002* (2013.01); *G07D 9/04* (2013.01)

(58) Field of Classification Search
CPC .. G07D 11/00; G07D 11/0087; G07D 11/009; G07D 11/0093; G07D 11/0096; G07D 11/10; G07D 11/12; G07D 11/125; G07D 11/14; G07D 11/16; G07D 11/24; G07D 11/245; G07D 11/40
USPC ..... 235/379
See application file for complete search history.

(56) References Cited

U.S. PATENT DOCUMENTS

| | | | | |
|---|---|---|---|---|
| 5,804,804 | A * | 9/1998 | Fukatsu | G07F 19/20 235/379 |
| 6,014,649 | A * | 1/2000 | Kobayashi | G06Q 20/108 705/43 |
| 6,293,540 | B1 * | 9/2001 | Kovacs | B65H 1/266 271/162 |
| 2003/0000957 | A1 * | 1/2003 | Brexel | G07D 11/26 221/129 |
| 2016/0314638 | A1 * | 10/2016 | Dopfer | G07D 11/12 |

OTHER PUBLICATIONS

Written Opinion for corresponding application PCT/IB2017/054816 filed Aug. 7, 2017; dated Oct. 10, 2017.

* cited by examiner

MACHINE FOR FILLING CASH BOXES AND DEVICE FOR RECEIVING AND MOVING A CASH BOX FOR SUCH A MACHINE

TECHNICAL FIELD

The present disclosure relates to a machine for filling boxes designed to contain money, for example coins and/or banknotes, which are inserted into the machine for carrying out the filling operation and subsequently removed from it.

BACKGROUND

More specifically, the machine forming the subject-matter of this disclosure is of the type normally used in banks, supermarkets and other commercial concerns to allow each authorized operator (for example the cashiers of the commercial concern) to insert, typically at the start of the shift, his own cash box (empty) so that it is filled by the machine with a predetermined quantity of coins and/or banknotes for performing the transactions with the customers (payments, giving change, etc.).

A depositing operation into the machine can of course be carried out by the operator even in case his relative cash box becomes completely full during the work shift.

The box, or container, for containing coins and/or banknotes to be filled is normally inserted into the machine by the operator, resting it inside a closable drawer, which can be partially extracted from the machine itself. After completing the filling operation, the drawer is again extracted and the filled box is withdrawn by the operator.

These machines are also advantageously equipped with an inlet for the introduction of coins and/or banknotes to be deposited into inner storage containers as a reserve to allow an appropriate filling of the cash boxes of the various operators and with a user interface, which can be used both for managing the introduction of money in the machine through said inlet and for managing the filling operations of the individual boxes by the cashiers.

The machines used in the prior art normally have an essentially vertical extension, wherein the inlet and the user interface are in the upper part, the storage containers are in the intermediate part and the extractable drawer designed to house the cash box to be filled is generally positioned in the lower part of the machine, under the inner storage containers, so as to allow the filling by gravity of the cash box with the coins present in the overlying storage containers.

This arrangement, whilst allowing a reasonable compactness of the machine and an appreciable constructional simplicity, is however extremely poor ergonomically as it forces the operator to bend down just to the ground every time he must insert and extract the cash box from the drawer of the machine. This drawback is particularly critical when the cash box is used mainly for containing coins, so that it can weigh, if full, even several kilograms. In fact, it is necessary to take into account that the operation for inserting/extracting the cash box into/from the machine may also have to be performed several times a day by the same operator.

Moreover, it should be considered that even the operations for opening and closing the drawer that houses the cash box must be carried out by the operator bending down.

BRIEF SUMMARY

The general aim of the present disclosure is to overcome the above-mentioned drawbacks by providing a machine for filling cash boxes, for example coins and/or banknotes, which allows the operator to insert and extract the box in an ergonomic manner, without having to bend down to the ground for lifting a container which can even be extremely heavy.

A further aim of this disclosure is to provide a machine for filling cash boxes, and in particular a device for receiving and moving such cash boxes, which allows a high degree of automation of the operations for withdrawal, filling and delivery of the box to the operator.

In view of these aims, it was thought to devise, according to the disclosure, a machine for filling cash boxes, said cash boxes being able to be inserted into and extracted from the machine, internally comprising a portion for housing storage containers containing a cash reserve intended to fill said cash boxes, characterized in that laterally to said inner storage containers a device for receiving and moving a cash box is arranged, said device for receiving and moving the cash box being equipped with at least vertical movement means for vertical movement of said cash box between a raised position, adapted for inserting/extracting it into/from the machine, and a lowered position, at a lower height with respect to that of the inner storage containers present in the machine.

According to the disclosure, it was also devised a device for receiving and moving a cash box, intended to be associated with a machine for filling cash boxes, characterized in that it comprises a fixed frame with at least vertical movement means for vertical movement of said cash box between a raised position, adapted for its insertion/extraction by an operator, and a lowered position, at a height adapted for the filling of the cash box by the machine.

BRIEF DESCRIPTION OF THE DRAWINGS

To aid the clarity of the explanation of the innovative principles of the present disclosure and the advantages thereof with respect to the prior art, a description will be made in the following of a possible embodiment applying those principles, with the aid of the accompanying drawings. In the drawings.

DETAILED DESCRIPTION

For simplicity of explanation and description, reference will be made hereinafter to boxes for containing coins and, more generally, to the management and movement of boxes for containing coins, even though it is clear that the innovative principles of this disclosure can also be applied to machines for the management and movement of boxes designed to contain other types of cash, for example banknotes for cashiers desks of commercial concerns, or boxes designed to contain both coins and banknotes.

Figure 1:
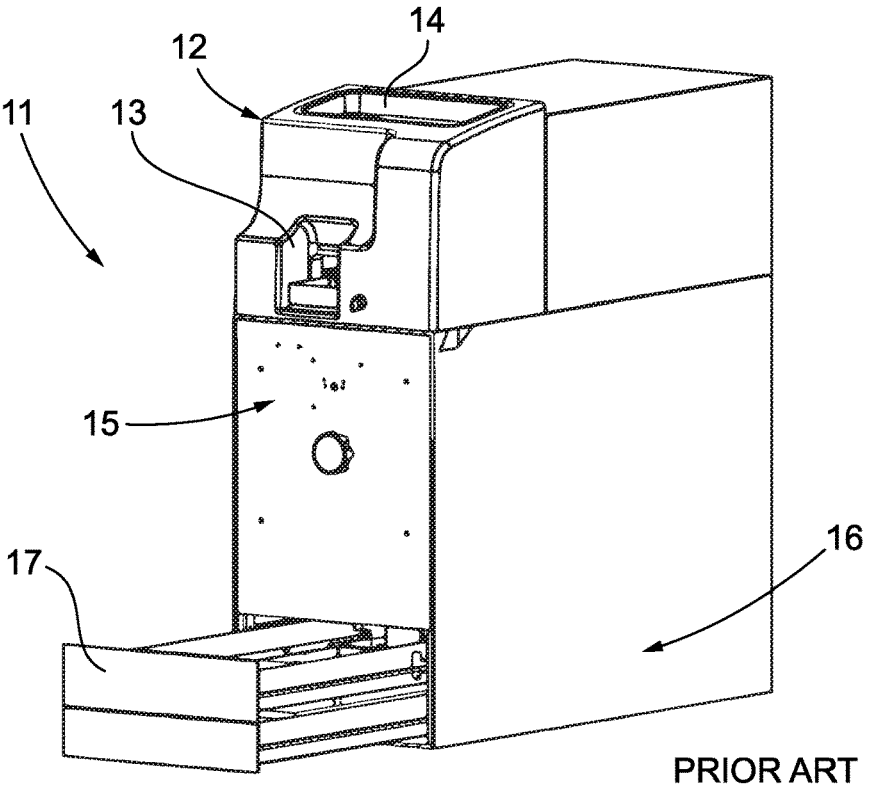
PRIOR ART Fig. 1
FIG. 1 is a perspective view of a machine for filling cash boxes according to the prior art.

With reference to the drawings, FIG. 1 illustrates a machine 11 for filling cash boxes according to the prior art.

The machine 11 comprises generically an upper portion 12 which has an inlet 13 for the introduction of coins (and/or banknotes) which are to be deposited in inner storage containers as a reserve to allow an appropriate filling of the boxes of the various operators and a user interface 14, which can be used both for managing the introduction of the cash in the machine through the inlet 13 and for managing the filling operations of the individual boxes by the cashiers.

The machine 11 also comprises an intermediate portion 15 designed to house the above-mentioned inner storage containers (not visible in the figures) and a lower portion 16 in which there is an extractable drawer 17 designed to house the cash box in such a way that, when the drawer 17 is closed, the cash box is positioned under said inner storage containers to allow the filling by gravity of the cash box by the coins present in the overlying storage containers.

When the operator needs to fill the respective cash box, he/she must open the lower drawer 17, insert the cash box inside it and then close the drawer itself. After completion of the filling operation by the inner storage containers, the operator opens the lower drawer 17 again, extracts the cash box full of coins and closes definitively the drawer.

As mentioned, such a machine configuration for the filling of cash boxes is extremely poor ergonomically as it forces the operator to bend down almost to the ground every time it is necessary to insert and extract the cash box (weighing, when full, even several kilograms) from the drawer of the machine.

Figure 2:
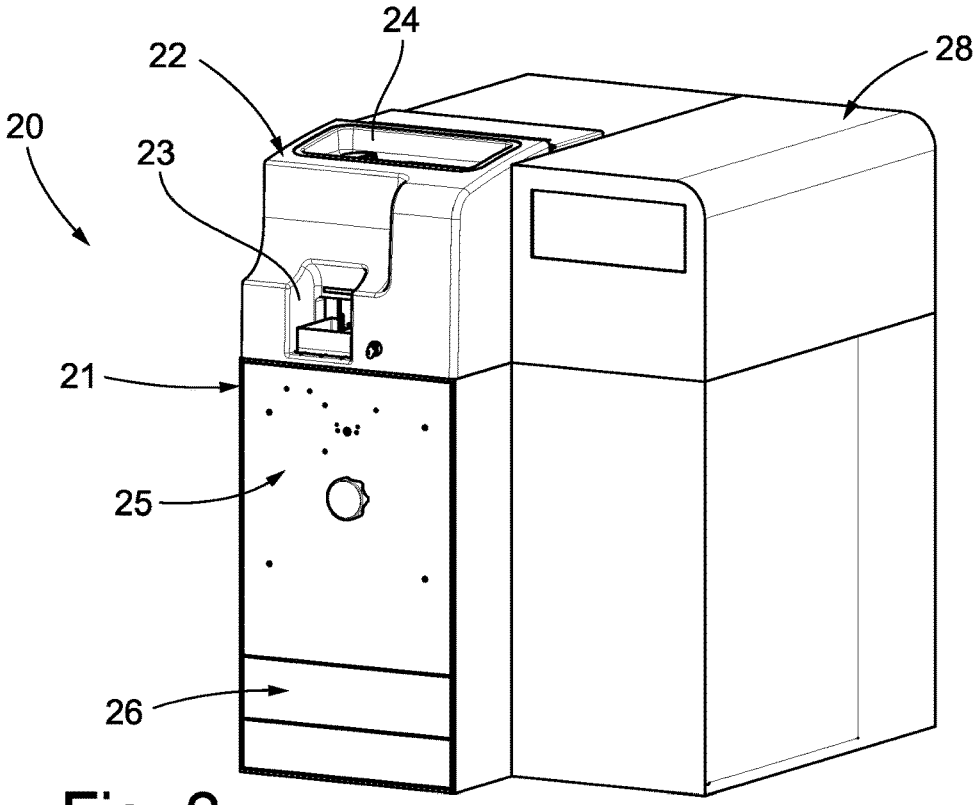
FIG. 2 is a perspective view of a machine for filling cash boxes according to this disclosure.

FIG. 2 illustrates a machine 20 for filling cash boxes according to this disclosure.

The machine 20 comprises a main body 21, with an upper portion 22 which has an inlet 23 for the introduction of coins (and/or banknotes) which are to be deposited in inner storage containers as a reserve to allow a correct filling of the boxes of the various operators and, advantageously, also a user interface 24, which can be used both for managing the introduction of the cash in the machine through the inlet 23 and for managing the filling operations of the individual boxes by the cashiers.

As mentioned, for simplicity of explanation and description, reference is made to boxes for containing coins, even though it is clear that the innovative principles of this disclosure can also be applied to machines for the management and movement of boxes designed to contain banknotes or both types of cash (coins and banknotes).

Figure 3:
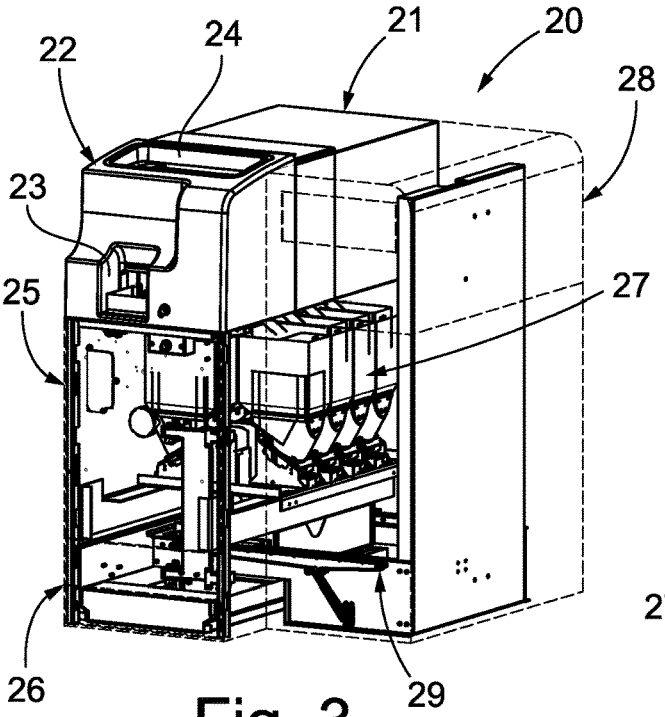
FIG. 3 is a view similar to that of FIG. 2, but with the outer casing partially removed to show the inner parts of the machine.

The main body 21 of the machine 20 also comprises an intermediate portion 25, designed to house the inner storage containers 27 (visible in FIG. 3) containing the reserve of coins to allow the filling of the boxes, and a lower portion 26 the function of which is described in detail below. Advantageously, the storage containers 27 are configured in terms of number and size so as to be suitable to each contain and dispense a specific coin denomination.

The machine 20 also comprises, laterally, an auxiliary body 28, designed to house a device 29 for receiving and moving the cash box. Said device for receiving and moving the cash box is therefore arranged laterally relative to the inner storage containers 27 present in the intermediate portion 25 of the machine.

Figure 4:
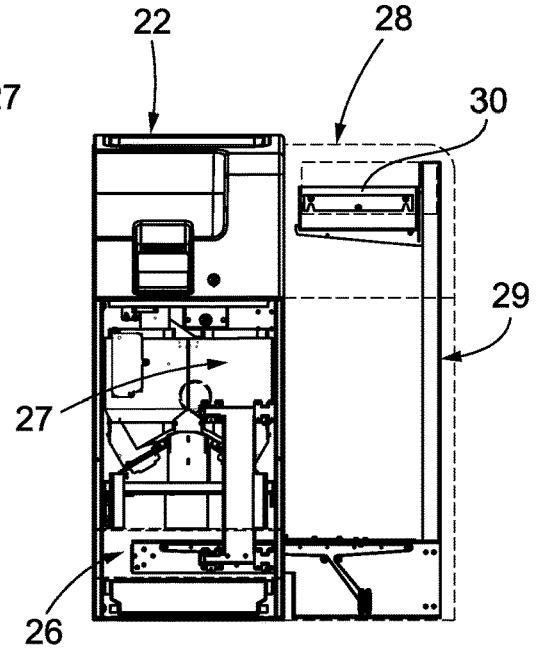
FIG. 4 is a front elevation view of the machine, with the outer casing partially removed, wherein the cash box is in a raised position, suitable for being inserted or extracted by the operator.
Figure 5:
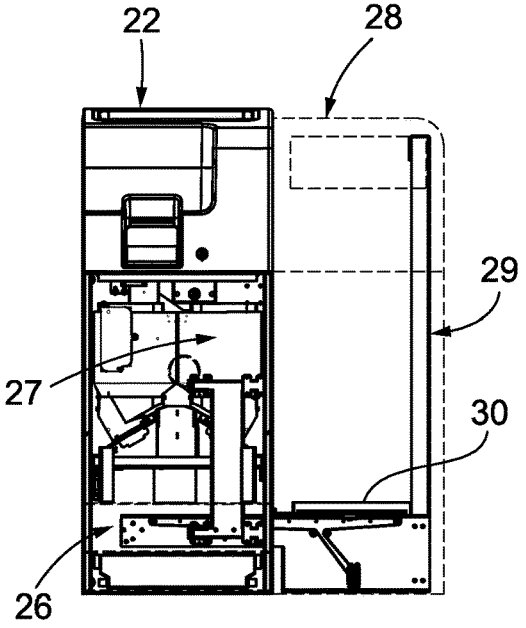
FIG. 5 is a view similar to that of FIG. 4, wherein the cash box is in a lowered position.
Figure 6:
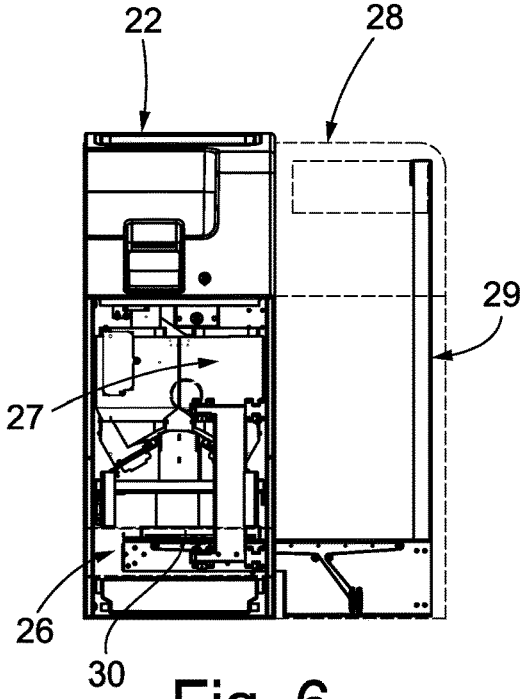
FIG. 6 is a view similar to that of FIG. 5, wherein the cash box is translated under the inner storage containers, in a suitable position for being filled with the cash contained in the storage containers.

In FIGS. 4-6 and 7-9 the cash box 30 is illustrated in different positions relative to the receiving and moving device 29 (FIGS. 7-9) and relative to the main body 21 of the machine (FIGS. 4-6).

As is well known to the technical expert, the cash box 30 (shown here schematically) may be equipped with a plurality of compartments, each designed to contain a specific coin denomination and, advantageously, intended to be associated, for filling, with a corresponding storage container 27 dedicated to that specific denomination.

As may be seen clearly in FIGS. 7, 8 and 9, the device 29 for receiving and moving the cash box 30 comprises a fixed frame 31 equipped with at least vertical movement means 32 for vertical movement of said cash box between a raised position, adapted for its insertion/extraction by the operator, and a lowered position, at a lower height with respect to that of the inner storage containers 27 present in the intermediate portion 25 of the main body 21 of the machine and, thus, adapted for the filling of the cash box, advantageously by gravity, by the machine.

Advantageously, the fixed frame 31 of the device 29 for receiving and moving the cash box 30 is also equipped with horizontal movement means 33 for horizontal movement of the cash box between said lowered position at the auxiliary body 28 of the machine and a position distanced from said auxiliary body 28, arranged at the lower portion 26 of the main body 21 under the inner storage containers 27.

According to a preferred embodiment, illustrated in the accompanying drawings, the device 29 for receiving and moving the cash box 30 also comprises an element 34 for housing and supporting the box itself. Such housing and supporting element 34 can advantageously be interchangeable for adapting the machine to different types and dimensions of the cash box 30, thereby constituting an adapter element for the box itself.

The vertical movement means 32 comprise, in particular, a first movable frame 35 connected to a slide 36 designed to slide vertically along a guide 37 fixedly connected to the fixed frame 31.

Appropriate motor-driven means (not shown in detail, since they can be easily deduced by a person skilled in the art) for driving the slide 36 along the guide 37 are naturally provided for actuating the vertical movement of said first movable frame 35.

Figure 7A:
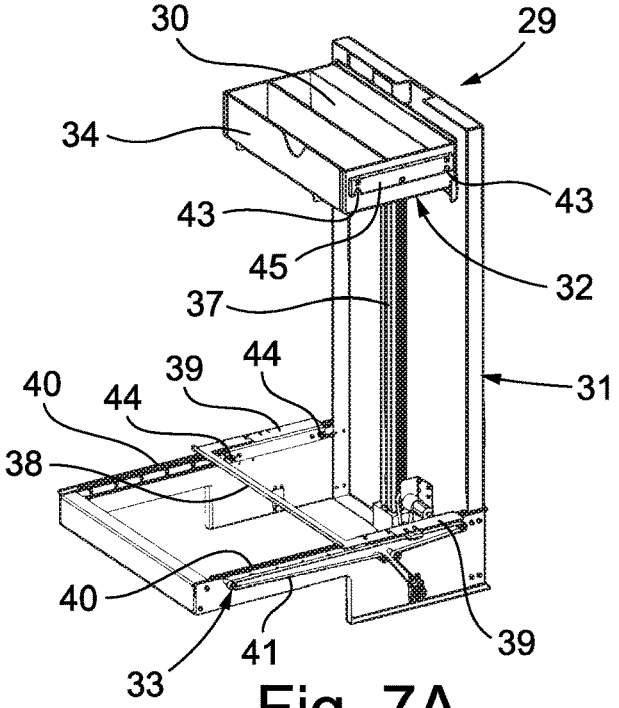
FIGS. 7A and 7B illustrate, respectively in a perspective view from above and from below, the device for moving the cash box under the conditions of FIG. 4.
Figure 7B:
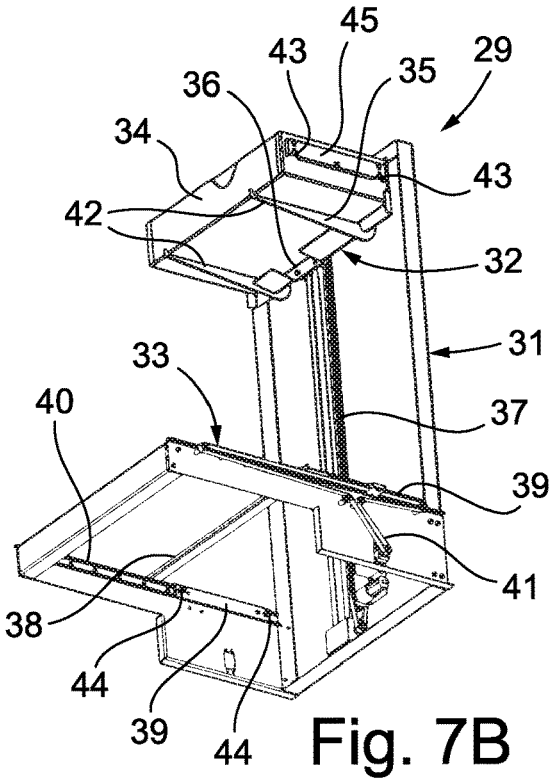

The first movable frame 35 constitutes a support for the element 34 for housing and supporting the cash box 30 (for example by means of a pair of brackets 42) when the cash box 30 is in the raised position illustrated in FIGS. 4, 7A and 7B and during the vertical movement of it.

The horizontal movement means 33 comprise, in turn, a second movable frame 38 equipped with a pair of side sliding blocks 39 designed to slide horizontally in respective guides 40 fixedly connected to the fixed frame 31.

Appropriate motor-driven means (for example a transmission belt 41) are provided to move the pair of side sliding blocks 39 of the second movable frame 38 along the respective horizontal guides 40.

Figure 8A:
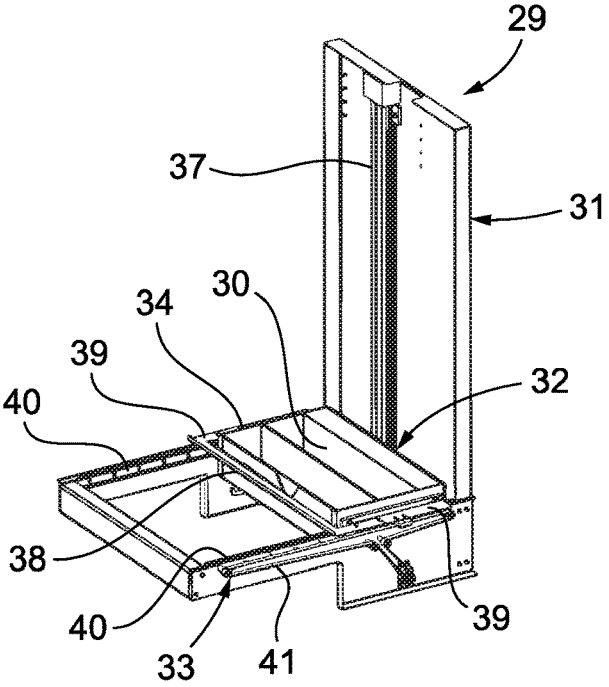
FIGS. 8A and 8B illustrate, by views similar to those of FIGS. 7A and 7B, the device for moving the cash box under the conditions of FIG. 5.
Figure 8B:
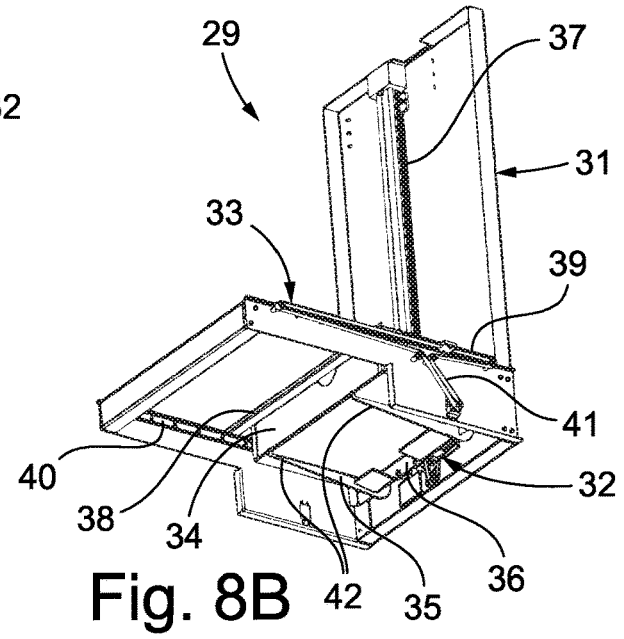

The second movable frame 38 in turn constitutes a support for the element 34 for housing and supporting the cash box 30 when the cash box 30 is in the lowered position illustrated in FIGS. 5, 8A and 8B and during the horizontal movement of it.

Figure 10:
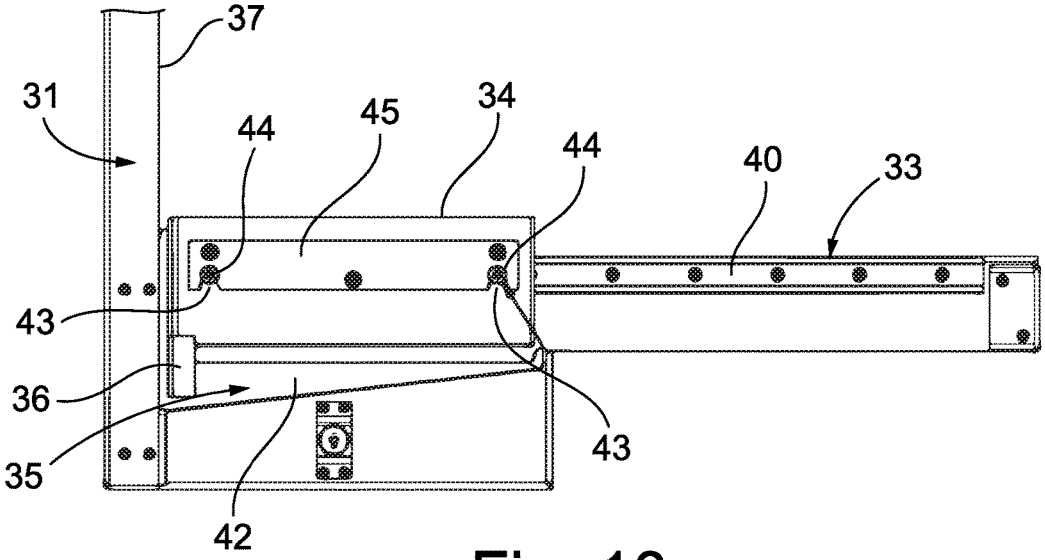
FIG. 10 shows an enlarged detail of the system for fixing the cash box to its movable support and of the system for horizontally guiding the support.

The support of the element 34 for housing and supporting the cash box on the second movable frame 38 is carried out by engagement of grooved seats 43, made integral with said housing and support element 34, with respective pins 44 fixed to the sliding blocks 39 of the second movable frame 38, as shown in FIGS. 7A, 7B and 10.

Advantageously, said grooved seats 43 are formed in a pair of handles 45 applied laterally to the element 34 for housing and supporting the cash box.

A brief description is given below of the operation of a machine for filling cash boxes according to this disclosure.

When an operator must fill a cash box 30, the device 29 for receiving and moving the cash box is controlled in such a way as to arrange the element 34 for housing and supporting the cash box 30 in the raised position, illustrated in FIGS. 4, 7A and 7B. In this condition, the operator can insert the empty cash box in the above-mentioned housing and supporting element 34 through a suitable opening provided in an appropriate position in the upper portion of the auxiliary body 28 of the machine, at a height such that it is not necessary for the operator to bend down.

Once the cash box 30 has been rested in the housing and supporting element 34, the receiving and moving device 29 vertically lowers the housing and supporting element 34 and the box 30 contained in it, by means of the vertical movement means 32 described above, to the lowered position illustrated in FIGS. 5, 8A and 8B.

Upon completion of the lowering stroke, the housing and supporting element 34 and the box 30 contained in it stop being supported by the first movable frame 35 which has allowed the lowering thereof along the vertical guide 37 and they rest, by means of the grooved seats 43, on the pins 44 protruding from the sliding blocks 39 of the second movable frame 38 which constitutes part of the horizontal movement means 33.

Figure 9A:
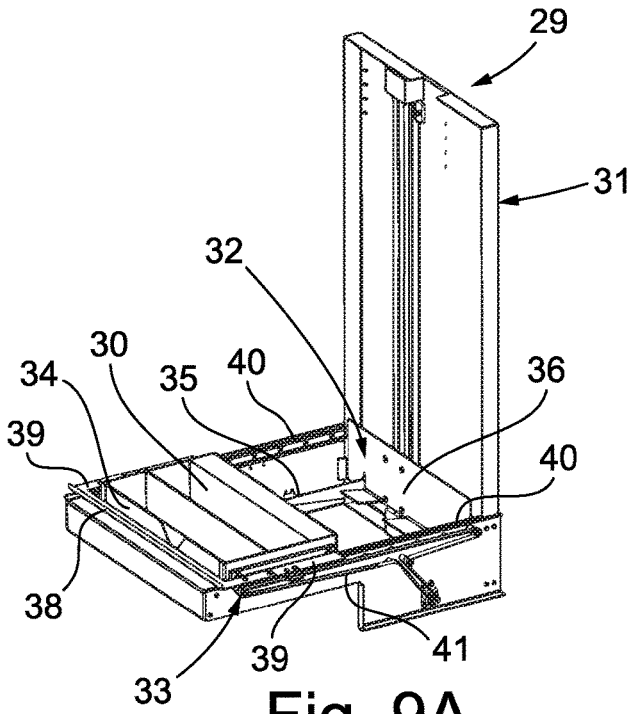
FIGS. 9A and 9B illustrate, by views similar to those of FIGS. 7A, 7B and 8A, 8B, the device for moving the cash box under the conditions of FIG. 6.
Figure 9B:
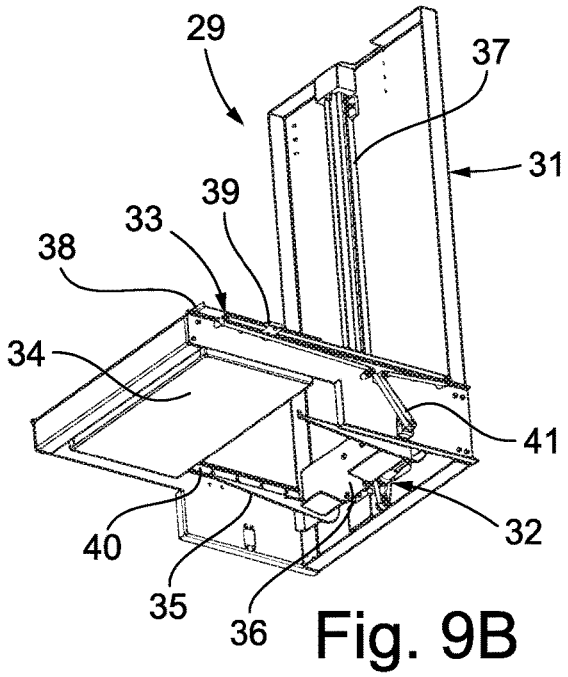

At this point, starting from the lowered position identified by the vertical movement means 32, the receiving and moving device 29 horizontally translates the housing and supporting element 34 and the box 30 contained in it, by the sliding of the side sliding blocks 39 of the second movable frame 38 in the respective horizontal guides 40, to the position illustrated in FIGS. 6, 9A and 9B, which is suitably distanced from the starting position of FIGS. 5, 8A and 8B in such a way as to be at the lower portion 26 of the main body 22 of the machine, under the inner storage containers 27. In particular, the arrangement of the various storage containers 27 in the main body 21 of the machine will be such that each of them will be associated with a corresponding compartment of the cash box, each designed to be filled with a specific coin denomination.

After filling of the cash box 30, the receiving and moving device 29 translates the housing and supporting element 34 and the box 30 contained in it in the reverse direction, moving them first horizontally to the position illustrated in FIGS. 5, 8A and 8B and then vertically to the raised position illustrated in FIGS. 4, 7A and 7B, where the operator can extract the full cash box from the machine, again without the need to bend down.

It is now clear how the machine and, in particular, the device for receiving and moving a cash box according to this disclosure allows the preset aims to be achieved.

Moreover, it should be considered that the receiving and moving device per se can be made in a structurally self-supporting and modular manner, in such a way that it can be applied separately even to existing machines for filling cash boxes.

Naturally the foregoing description of an embodiment applying the innovative principles of the present disclosure is made by way of exemplifying such innovative principles and must therefore not be taken as a limitation of the scope of the protection as claimed herein.

For example, the device 29 for receiving and moving the cash box 30 could comprise only the vertical movement means 32 for transferring the cash box 30 from the raised position illustrated in FIGS. 4, 7A and 7B, adapted for the receiving and for the return of the box to the operator, to the lowered position illustrated in FIGS. 5, 8A and 8B and vice versa.

In this case, the machine 20 may be equipped with appropriate pipes (not illustrated in the accompanying drawings) for conveying coins from the inner storage containers 27 to the cash box 30 arranged in the above-mentioned lowered position.

Moreover, the means for actuating the movable frames 35, 38 of the vertical and horizontal movement means 32, 33 could be different from those described and illustrated here, as each time it is possible to use, according to the specific requirements, actuators consisting of belts, slides, racks, etc., as is well known to the technical expert.

Lastly, the directions of movement of the means 32, 33 for transferring the cash box could also be not strictly vertical and horizontal, but have a slightly different inclination, however with a main vertical and horizontal component, respectively.

The invention claimed is:

1. A machine for filling cash boxes, said cash boxes being able to be inserted into and extracted from the machine, internally comprising a portion for housing storage containers containing a cash reserve intended to fill said cash boxes, laterally to said inner storage containers a device for receiving and moving a cash box is arranged, said device for receiving and moving the cash box being equipped with at least vertical movement means for vertical movement of said cash box between a raised position, adapted for inserting and extracting said cash box into and from the machine, and a lowered position, at a lower height with respect to that of the inner storage containers present in the machine.

2. The machine according to claim 1, wherein the device for receiving and moving the cash box is also equipped with horizontal movement means for horizontal movement of the cash box between said lowered position defined by the vertical movement means and a position distanced from said lowered position, arranged under the inner storage containers present in the machine.

3. The machine according to claim 2, wherein the machine comprises a main body having said portion for housing storage containers and an auxiliary body arranged laterally to the main body and configured to house the device for receiving and moving the cash box, the main body further comprising a lower portion disposed below the inner storage containers, wherein said distanced position, defined by the horizontal movement means, is arranged at the lower portion of the main body.

4. The machine according to claim 1, wherein said vertical movement means comprise a first movable frame for the support of the cash box when the cash box is in said raised position and during vertical movement of the cash box, said first movable frame being connected to a slide designed to slide vertically along a fixed guide.

5. The machine according to claim 2, wherein said horizontal movement means comprise a first movable frame for the support of the cash box when the cash box is in said lowered position and during horizontal movement of the cash box, said first movable frame being equipped with side sliding blocks designed to slide horizontally in respective guides.

6. The machine according to claim 4, wherein the device for receiving and moving the cash box further comprises an element for housing and supporting the cash box, said element for housing and supporting the cash box being supported by the first movable frame in the raised position and during the vertical movement and by a second movable frame in the lowered position and during the horizontal movement.

7. The machine according to claim 6, wherein the support of the element for housing and supporting the cash box on the second movable frame is carried out by engagement of grooved seats, made integral with said housing and support element, with respective pins fixed to the sliding blocks of the second movable frame.

8. The machine according to claim 7, wherein said grooved seats are formed in a pair of handles applied laterally to the element for housing and supporting the cash box.

9. The machine according to claim 1, wherein the machine comprises a main body in which said portion for housing the inner storage containers is housed and an auxiliary body, arranged laterally to the main body and designed to house the device for receiving and moving the cash box.

10. The machine according to claim 9, wherein the main body also comprises an upper portion that has an inlet for introducing cash intended to be deposited in the inner storage containers and a lower portion, below the inner storage containers, the portion for housing the inner storage containers being intermediate between said upper portion and said lower portion.

11. The machine according to claim 1, wherein the cash box is equipped with a plurality of spaces, each intended to be associated, for filling, with a corresponding storage container.

12. A device for receiving and moving a cash box, intended to be associated with a machine for filling cash boxes, comprising a fixed frame with at least vertical movement means for lowering of said cash box in an empty condition from a raised position, adapted for insertion of an empty cash box by an operator, to a lowered position, at a height adapted for filling of said empty cash box by the machine, and for raising of said cash box in a full condition from said lowered position to said raised position, adapted for extracting of the full cash box by the operator.

13. The device for receiving and moving the cash box according to claim 12, wherein said fixed frame is also equipped with horizontal movement means for horizontal movement of the cash box between said lowered position defined by the vertical movement means and a position distanced from said lowered position, adapted for the filling of the cash box.

14. The device for receiving and moving the cash box according to claim 13, wherein the horizontal movement means comprise a first movable frame for the support of the cash box when the cash box is in said lowered position and during horizontal movement, said first movable frame being equipped with side sliding blocks designed to slide horizontally in respective guides fixedly connected to the fixed frame.

15. The device for receiving and moving said cash box according to claim 12, wherein the vertical movement means comprise a first movable frame for the support of the cash box when the cash box is in said raised position and during vertical movement of the cash box, said first movable frame being connected to a slide designed to slide vertically along a guide fixedly connected to the fixed frame.

16. The device for receiving and moving the cash box according to claim 15, wherein said fixed frame includes horizontal movement means for horizontal movement of the cash box between said lowered position and a position distanced from said lowered position, adapted for filling of the cash box, horizontal movement means comprising a second movable frame configured to support the cash box when the cash box is in said lowered position and during horizontal movement, said second movable frame comprising a plurality of side sliding blocks configured to slide horizontally in a plurality of guides fixedly connected to said fixed frame, the device further comprising an element for housing and supporting the cash box, said element being supported by the first movable frame in the raised position and during the vertical movement and by the second movable frame in the lowered position and during the horizontal movement.

17. The device for receiving and moving the cash box according to claim 16, wherein the support of the element for housing and supporting the cash box on the second movable frame is carried out by engagement of grooved seats, made integral with said housing and support element, with respective pins fixed to the sliding blocks of the second movable frame.

18. The device for receiving and moving the cash box according to claim 17, wherein said grooved seats are formed in a pair of handles applied laterally to the element for housing and supporting the cash box.

* * * * *